US010025260B2

(12) United States Patent
Tashiro et al.

(10) Patent No.: US 10,025,260 B2
(45) Date of Patent: Jul. 17, 2018

(54) DAMPER MECHANISM AND IMAGE FORMING APPARATUS THEREWITH

(71) Applicant: KYOCERA Document Solutions Inc., Osaka (JP)

(72) Inventors: Yoshiaki Tashiro, Osaka (JP); Takehiro Sato, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/442,124

(22) Filed: Feb. 24, 2017

(65) Prior Publication Data

US 2017/0285558 A1 Oct. 5, 2017

(30) Foreign Application Priority Data

Mar. 29, 2016 (JP) ..... 2016-066004

(51) Int. Cl.
*G03G 15/20* (2006.01)
*G03G 21/16* (2006.01)
*E05F 1/10* (2006.01)

(52) U.S. Cl.
CPC ..... *G03G 21/1633* (2013.01); *E05F 1/1058* (2013.01); *G03G 15/2032* (2013.01); *G03G 15/2035* (2013.01); *G03G 15/2067* (2013.01); *G03G 15/2071* (2013.01); *G03G 21/1623* (2013.01); *G03G 21/1638* (2013.01); *G03G 21/1647* (2013.01); *G03G 21/1695* (2013.01); *G03G 2215/0067* (2013.01);
(Continued)

(58) Field of Classification Search
CPC ..... G03G 15/2032; G03G 15/2035; G03G 15/2067; G03G 15/2071; G03G 21/1623; G03G 21/1633; G03G 21/1638; G03G 21/1647; G03G 21/1695; G03G 2215/0067; G03G 2215/0154; G03G 2221/1651; G03G 2221/1654; G03G 2221/672; G03G 2221/1675; G03G 2221/1684; G03G 2221/1687; G03G 2221/169; E05F 1/1058
See application file for complete search history.

(56) References Cited

U.S. PATENT DOCUMENTS 7,433,629 B2 * 10/2008 Tomatsu ..... G03G 21/1633 16/85
8,699,919 B2 * 4/2014 Takamori ..... E05F 5/02 312/327
2011/0158680 A1 * 6/2011 Koiwai ..... G03G 21/1633 399/110

FOREIGN PATENT DOCUMENTS

JP 2001-142271 A 5/2001
JP 2007-57880 A 3/2007

* cited by examiner

*Primary Examiner* — Joseph S Wong
(74) *Attorney, Agent, or Firm* — Stein IP, LLC

(57) ABSTRACT

A damper mechanism has first and second rail members, a biasing member, and a slide member. The first rail member is fixed inside the opening/closing member along the up/down direction, and has an oblong guide hole formed therein extending along the longitudinal direction. The second rail member has fixed to a top end part thereof an engaging pin inserted through the guide hole, and has a bottom end part swingably supported on the apparatus main body. The biasing member biases the first and second rail members in a direction in which these approach each other. The slide member is made of resin fixed to the engaging pin, slides while in contact with the first rail member and the opening/closing member, and prevents contact between the engaging pin and an inner circumferential rim of the guide hole.

12 Claims, 5 Drawing Sheets

(52) U.S. Cl.
CPC ..... *G03G 2215/0154* (2013.01); *G03G 2221/169* (2013.01); *G03G 2221/1651* (2013.01); *G03G 2221/1654* (2013.01); *G03G 2221/1675* (2013.01); *G03G 2221/1684* (2013.01); *G03G 2221/1687* (2013.01)

DAMPER MECHANISM AND IMAGE FORMING APPARATUS THEREWITH

INCORPORATION BY REFERENCE

This application is based upon and claims the benefit of priority from the corresponding Japanese Patent Application No. 2016-066004 filed on Mar. 29, 2016, the entire contents of which are incorporated herein by reference.

BACKGROUND

The present disclosure relates to a damper mechanism of an opening/closing member used in image forming apparatuses such as copiers, printers, facsimile machines, and multifunctional peripherals thereof, and to an image forming apparatus incorporating such a damper mechanism.

Typically, in conventional image forming apparatuses such as copiers, printers, and digital multifunctional peripherals, to make the entire image forming apparatus compact, a sheet transport passage is arranged near a side face of the image forming apparatus main body in the vertical direction. In the transport passage arranged in the vertical direction, a transport roller pair is arranged for transporting sheets. Generally, to handle a jam and perform maintenance, a configuration is adopted in which a transport unit is arranged, which is provided with one roller of a transport roller pair, a transfer roller which forms a transfer nip by being pressed against an image carrying member, and the like, so as to be openable/closable with respect to an image forming apparatus main body so that a transport passage is exposed largely.

Some methods have been proposed for improving the operability when a transport unit is opened or closed, and an image forming apparatus is known which incorporates a damper mechanism that biases an opening/closing unit in the closing direction.

SUMMARY

According to one aspect of the present disclosure, a damper mechanism is provided between an apparatus main body and an opening/closing member, and reduces a moment generated when the opening/closing member is swung from a close position to an open position. The opening/closing member is supported on the apparatus main body so as to be swingable up and down between the open position and the close position with a bottom end part of the opening/closing member serving as a fulcrum. The damper mechanism includes a first rail member, a second rail member, a biasing member, and a slide member. The first rail member is fixed inside the opening/closing member along the up/down direction, and has a guide hole formed therein in a shape of an oblong hole extending along the longitudinal direction. The second rail member has fixed to a top end part thereof an engaging pin inserted through the guide hole, and has a bottom end part swingably supported on the apparatus main body. The biasing member biases the first and second rail members in a direction in which these approach each other. The slide member is made of resin fixed to the engaging pin, slides while in contact with the first rail member and the opening/closing member, and prevents contact between the engaging pin and an inner circumferential rim of the guide hole.

Further features and advantages of the present disclosure will become apparent from the description of embodiments given below.

DETAILED DESCRIPTION

Figure 1:
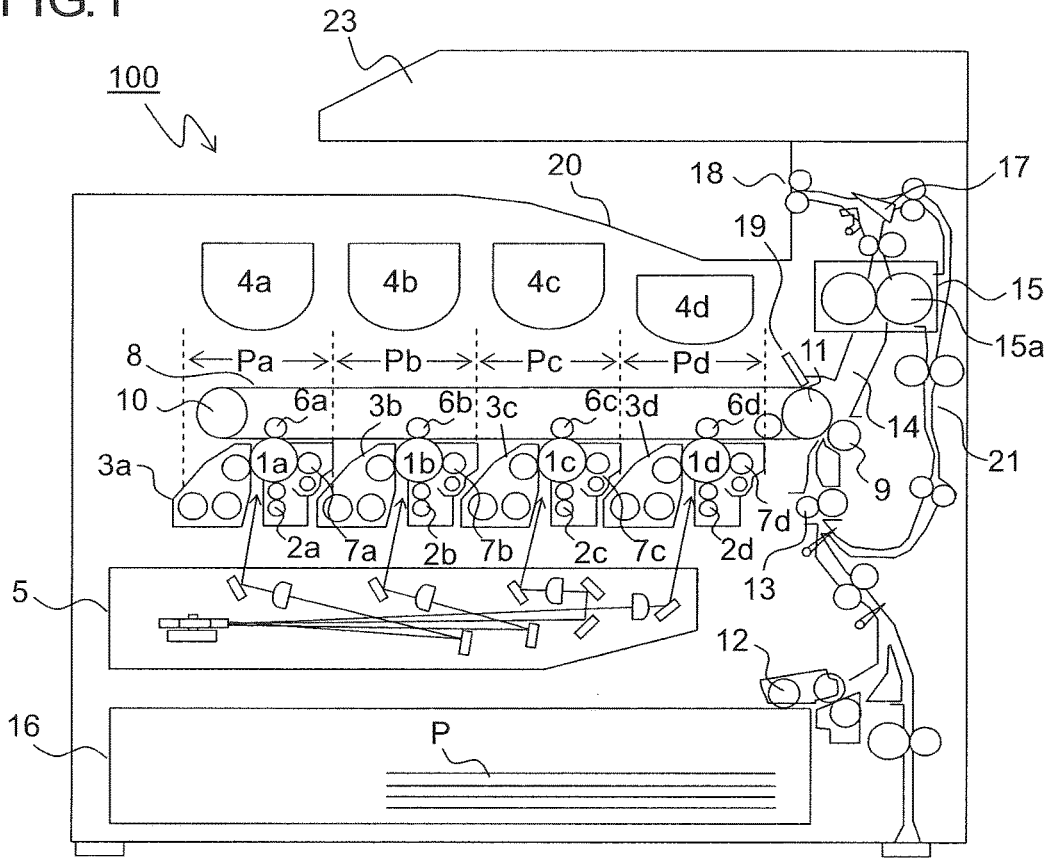
FIG. 1 is a schematic sectional view of an overall construction of an image forming apparatus incorporating a damper mechanism according to the present disclosure.

Hereinafter, embodiments of the present disclosure will be described with reference to the accompanying drawings. FIG. 1 is a sectional view showing an outline of a construction of an image forming apparatus 100 incorporating a damper mechanism 40 according to the present disclosure. In this embodiment, the image forming apparatus 100 is a quadruple-tandem-type color copier that performs image formation by use of four photosensitive drums 1*a*, 1*b*, 1*c*, and 1*d*, corresponding to four different colors (magenta, cyan, yellow, and black) respectively, which are arranged side by side.

Inside the apparatus main body of the image forming apparatus 100, four image forming portions Pa, Pb, Pc, and Pd are arranged in this order from the left side in FIG. 1. These image forming portions Pa to Pd are provided to correspond to images of four different colors (magenta, cyan, yellow, and black) respectively, and sequentially form magenta, cyan, yellow, and black images respectively, each through the processes of electrostatic charging, exposure to light, image development, and image transfer.

In these image forming portions Pa to Pd are respectively arranged the above-mentioned photosensitive drums 1*a* to 1*d* that carry visible images (toner images) of the different colors. Moreover, an intermediate transfer belt 8 that rotates in the counter-clockwise direction in FIG. 1 is arranged next to the image forming portions Pa to Pd.

Sheets P to which toner images are to be transferred are stored in a sheet feed cassette 16 arranged in a lower part of the image forming apparatus 100 main body, and are transported to a secondary transfer roller 9 via a sheet feeding roller 12, a registration roller pair 13, and a sheet transport passage 14. On the downstream side of the secondary transfer roller 9, a blade-shaped belt cleaner 19 is arranged for removing toner and the like remaining on the surface of the intermediate transfer belt 8.

Now, the image forming portions Pa to Pd will be described. Around and under the photosensitive drums 1*a* to 1*d*, which are rotatably arranged, there are arranged charging devices 2*a*, 2*b*, 2*c*, and 2*d* which electrostatically charge the photosensitive drums 1*a* to 1*d*, an exposure unit 5 which exposes the photosensitive drums 1*a* to 1*d* to light based on image data, developing devices 3*a*, 3*b*, 3*c*, and 3*d* which develop, by use of toner, electrostatic latent images formed on the photosensitive drums 1*a* to 1*d*, and cleaning devices 7*a*, 7*b*, 7*c*, and 7*d* which collect and remove developer (toner) left unused on the photosensitive drums 1*a* to 1*d* after toner images have been transferred.

The image reading portion 23 is composed of a scanning optical system that incorporates a scanner lamp which illuminates a document during copying and a mirror which changes the optical path of light reflected from the document, a converging lens which converges the light reflected from the document to form an image, a CCD (charge-coupled device) sensor which converts image light of the formed image into an electrical signal, and the like (none of these is illustrated). The image reading portion 23 reads a document image and converts it into image data.

A copy operation proceeds as follows. In the image reading portion 23, image data of a document is read and converted into an image signal. On the other hand, the surfaces of the photosensitive drums 1*a* to 1*d* are electrostatically charged uniformly by the charging devices 2*a* to 2*d* and are then irradiated with light based on the image data by the exposure unit 5, and thereby electrostatic latent images based on the image data are formed on the photosensitive drums 1*a* to 1*d* respectively. The developing devices 3*a* to 3*d* have developing rollers (developer carrying members) arranged opposite the photosensitive drums 1*a* to 1*d*, and are charged with predetermined amounts of two-component developer containing toner of different colors, namely magenta, cyan, yellow, and black respectively.

When the proportion of toner contained in the two-component developer stored in the developing devices 3*a* to 3*d* falls below a predetermined value through formation of toner images, which will be described later, developer is supplied from containers 4*a* to 4*d* to the developing devices 3*a* to 3*d*.

Then, a predetermined transfer voltage is applied between primary transfer rollers 6*a* to 6*d* and the photosensitive drums 1*a* to 1*d* by the primary transfer rollers 6*a* to 6*d*, and thereby magenta, cyan, yellow, and black toner images on the photosensitive drums 1*a* to 1*d* are primarily transferred to the intermediate transfer belt 8. Toner left unused on the surfaces of the photosensitive drums 1*a* to 1*d* after primary transfer is removed by the cleaning devices 7*a* to 7*d*.

The intermediate transfer belt 8 is wound around a following roller 10 and a driving roller 11. As the driving roller 11 rotates by being driven by the above-mentioned belt driving motor, the intermediate transfer belt 8 rotates in the counter-clockwise direction; meanwhile, a sheet P is transported from the registration roller pair 13, with predetermined timing, to a nip (secondary transfer nip) between the secondary transfer roller 9, which is arranged next to the intermediate transfer belt 8, and the intermediate transfer belt 8. At the nip, the full-color image is secondarily transferred to the sheet P. The sheet P having the toner images transferred to it is transported via the sheet transport passage 14 to the fixing device 15.

The sheet P transported to the fixing device 15 is heated and pressed while passing through a nip (fixing nip) between a fixing roller pair 15*a*, and thereby the toner images are fixed to the surface of the sheet P to form the predetermined full-color image. The sheet P having the full-color image formed on it is, as it is (or after being distributed into a reverse transport passage 21 by a branching portion 17 and having images formed on both sides of it) discharged via a discharge roller pair 18 onto a discharge tray 20.

Figure 2:
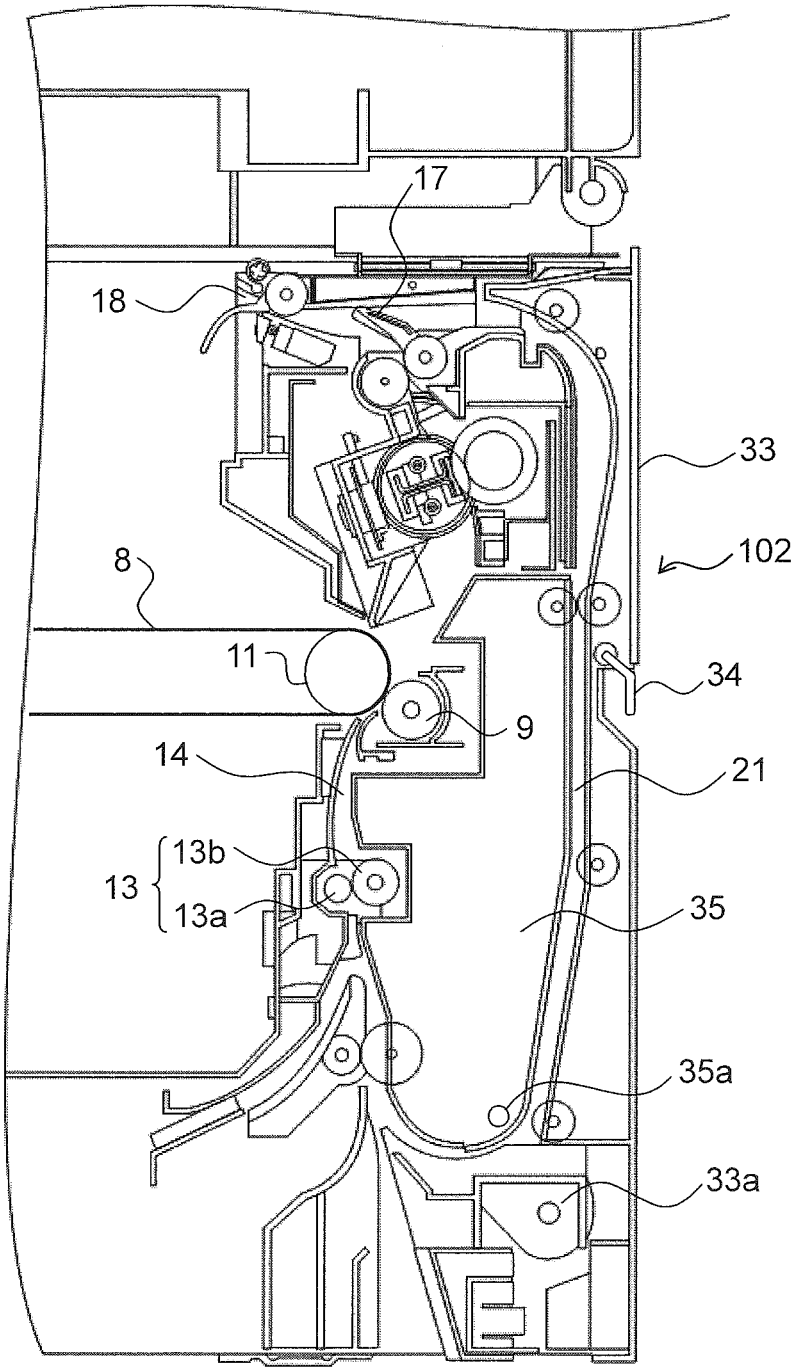
FIG. 2 is a sectional view around a sheet transport passage and a reverse transport passage in the image forming apparatus according to one embodiment.

FIG. 2 is a sectional view around the sheet transport passage 14 and the reverse transport passage 21 in the image forming apparatus 100 in FIG. 1. A side face cover 33 constitutes a side face 102 of the image forming apparatus 100, and is swingably supported on a fulcrum 33*a* arranged in a lower part of the image forming apparatus 100 main body. An inner surface of the side face cover 33 constitutes one transport surface of the reverse transport passage 21. When the side face cover 33 alone is swung in the opening direction with respect to the image forming apparatus 100, the reverse transport passage 21 is exposed largely. When the side face cover 33 is swung together with a transport unit 35 in the opening direction, the transport unit 35 moves away from the image forming apparatus 100 main body side, and thereby the sheet transport passage 14 is exposed largely. On the other hand, when the side face cover 33 is swung together with the transport unit 35 in the closing direction, the transport unit 35 abuts on the image forming apparatus 100 main body side, and the secondary transfer roller 9 is pressed against the driving roller 11.

Inside the side face cover 33, the transport unit 35 is arranged. The transport unit 35 is swingably supported on the image forming apparatus 100 main body about a support shaft 35*a*, and constitutes part of the transport surfaces of the reverse transport passage 21 and the sheet transport passage 14. The reverse transport passage 21 extends, between the side face cover 33 and the transport unit 35, in the up/down direction along the side face 102 of the image forming apparatus 100, and curves in a substantially C-shape so as to join the sheet transport passage 14.

On the inner surface of the transport unit 35, there are provided, in order from the upstream side (the bottom side in FIG. 2) in the sheet transport direction, one roller 13*b* which is included in the registration roller pair 13, and the secondary transfer roller 9 which is a first roller. The secondary transfer roller 9 presses against the driving roller 11, which is a second roller, across the intermediate transfer belt 8.

When handling a jam in the reverse transport passage 21, swinging the side face cover 33 alone in the clockwise direction from the state in FIG. 2 opens the reverse transport passage 21. On the other hand, when handing a jam in the sheet transport passage 14, swinging the transport unit 35 together with the side face cover 33 in the clockwise direction opens the sheet transport passage 14. Here, the secondary transfer roller 9 moves away from the driving roller 11, and one roller 13*b* included in the registration roller pair 13 moves away from the other roller 13*a*. Then, after a sheet is removed, by swinging the transport unit 35 and the side face cover 33 in the counter-clockwise direction in FIG. 2 to bring them back into the state in FIG. 2, the transport unit 35 is located such that the secondary transfer roller 9 is in pressed contact with the driving roller 11 and the roller 13*b* is in pressed contact with the roller 13*a*.

Incidentally, when the transport unit 35 is swung together with the side face cover 33 in the opening direction from the state in FIG. 2, the operability is degraded due to the weight felt when the side face cover 33 is held, the shock felt when the side face cover 33 reaches an open position, and the like. Thus, the image forming apparatus 100 according to the embodiment incorporates the damper mechanism 40 for reducing a force necessary to open and close the transport unit 35 and for reducing the shock occurring when the transport unit 35 is opened or closed.

Figure 3:
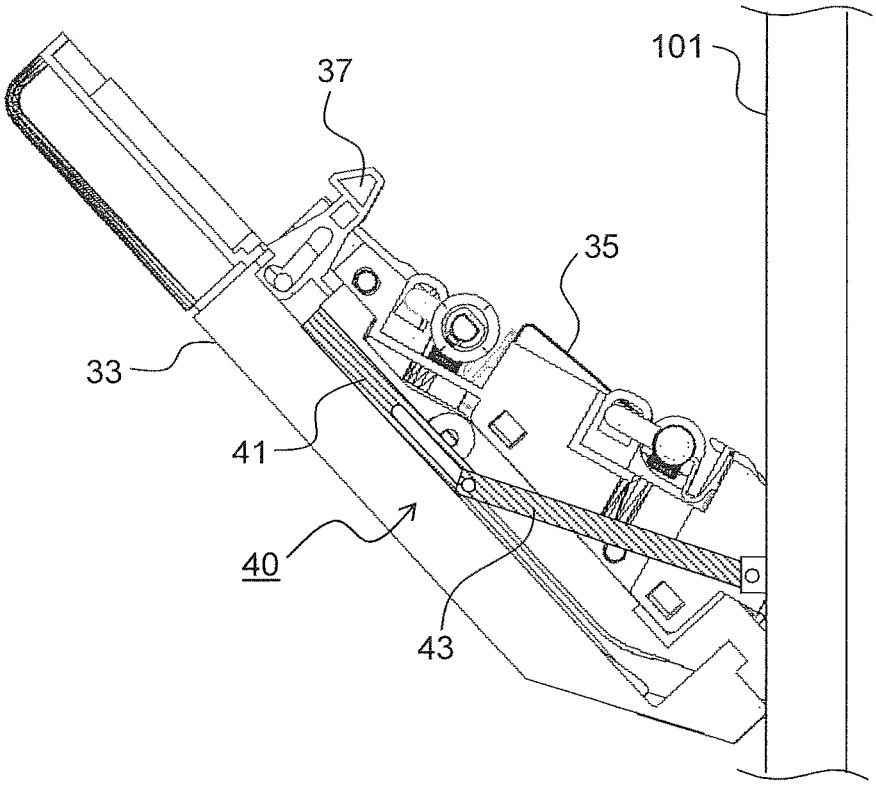
FIG. 3 is a side view showing a state with a side face cover and a transport unit open.
Figure 4:
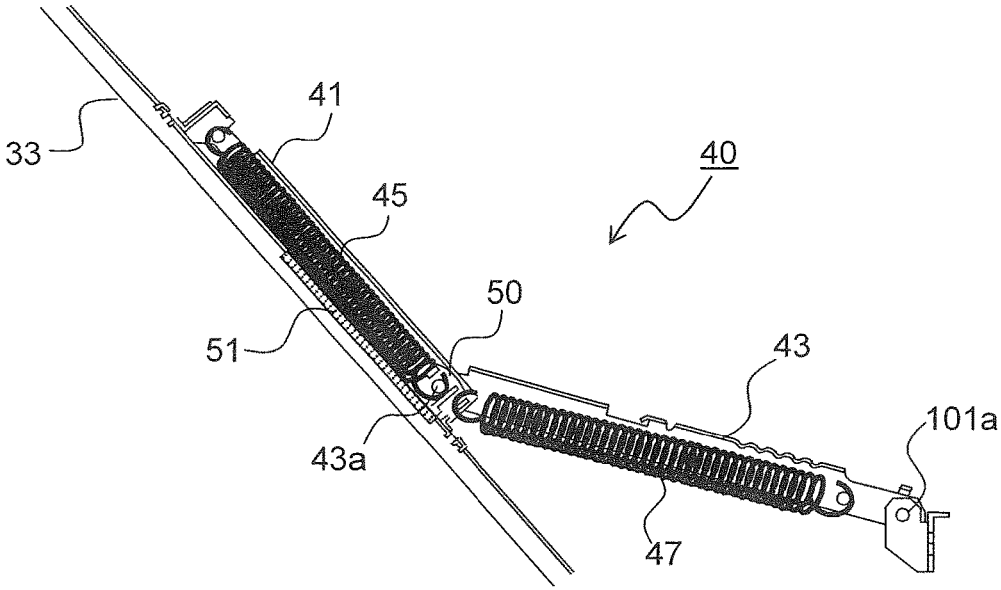
FIG. 4 is a side sectional view of a damper mechanism according to a first embodiment of the present disclosure as cut along the longitudinal direction, showing a state with the side face cover open.
Figure 5:
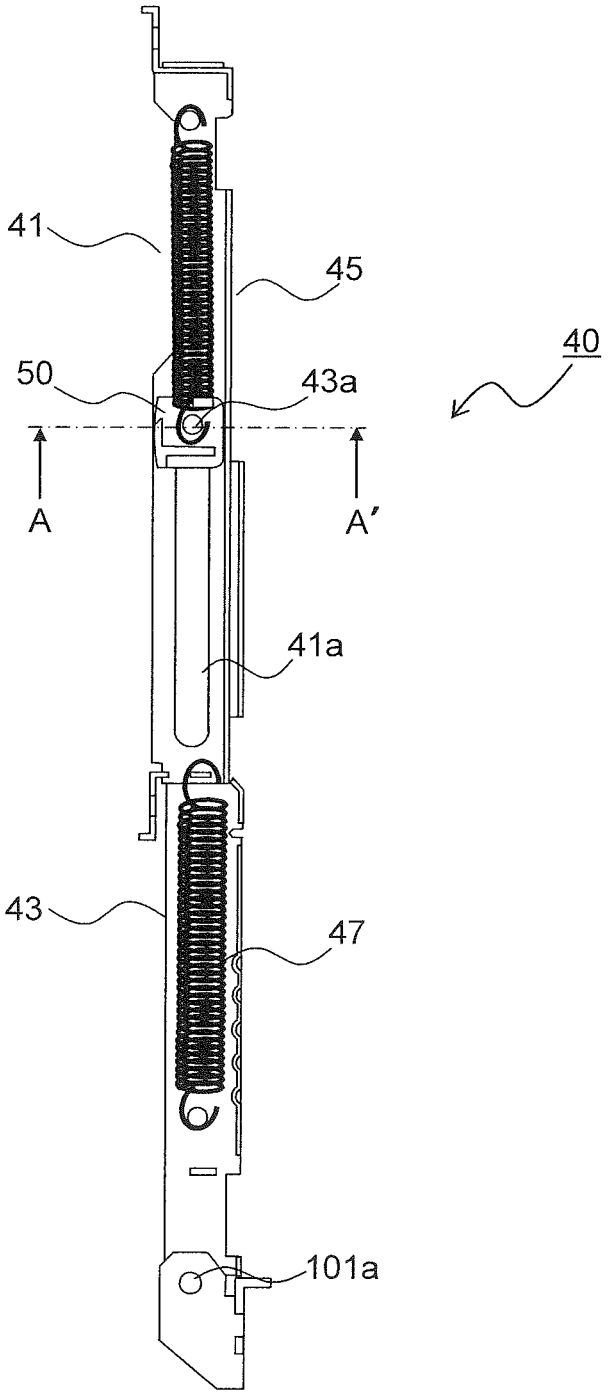
FIG. 5 is a side sectional view of the damper mechanism according to the first embodiment as cut along the longitudinal direction, showing a state with the side face cover closed.
Figure 6:
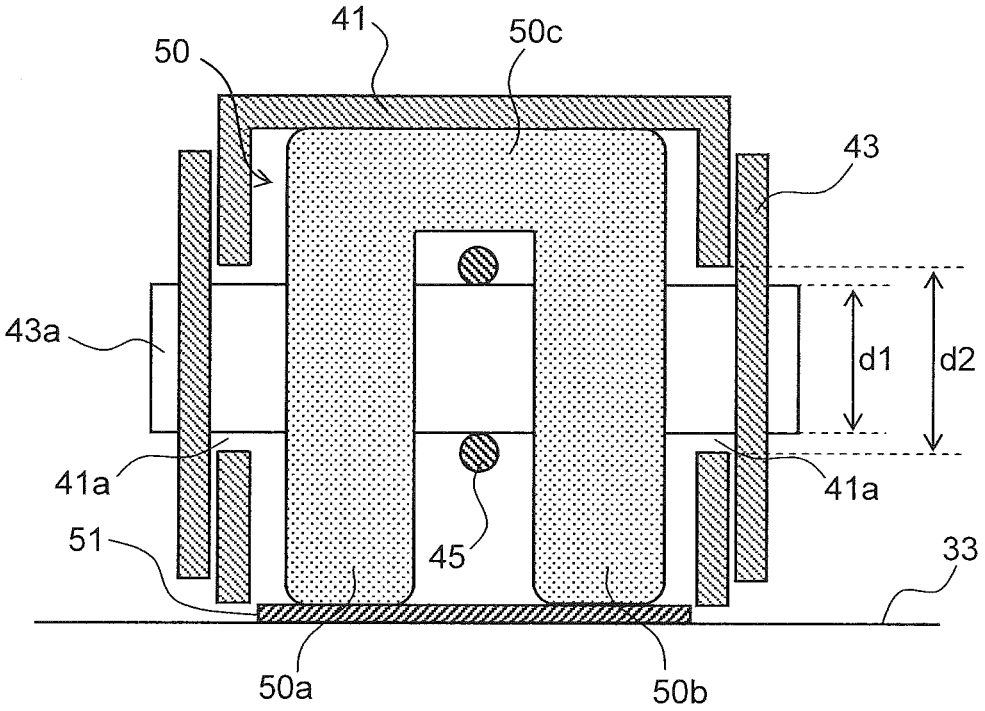
FIG. 6 is a sectional view of the damper mechanism according to the first embodiment as cut in the direction perpendicular to the longitudinal direction at the position of a slide member.

FIG. 3 is a side view showing a state where the side face cover 33 and the transport unit 35 are open. FIGS. 4 and 5 are side sectional views of the damper mechanism 40, with the side face cover 33 open and closed respectively, according to a first embodiment of the present disclosure as cut along the longitudinal direction. FIG. 6 is a sectional view (seen from the direction indicated by arrows A and A' in FIG. 5) of the damper mechanism 40 as cut in the direction perpendicular to the longitudinal direction at the position of a slide member 50. FIG. 3 shows the side face cover 33 and the transport unit 35 as seen from behind (the rear side with respect to the plane of FIG. 2) the image forming apparatus 100, and accordingly, in FIG. 3, the opening/closing direction of the side face cover 33 is reversed left to right as compared with that in FIG. 2.

A pair of damper mechanisms 40 is provided in left and right side end parts of the side face cover 33 respectively. FIGS. 4 and 5 show the damper mechanism 40 provided on one end side (rear side) of the side face cover 33. The damper mechanism 40 provided on the other end side (front side) of the side face cover 33 has exactly the same structure.

The damper mechanism 40 includes a first rail member 41, a second rail member 43, a first coil spring 45, a second coil spring 47, and a slide member 50.

The first rail member 41 is formed by bending a metal sheet into a shape with a U-shaped section, and is fixed to an inner surface of the side face cover 33 along the up/down direction. In the first rail member 41, a guide hole 41*a* is formed in the shape of an oblong hole extending downward from the center in the longitudinal direction.

The second rail member 43 is formed by bending a metal sheet. The second rail member 43 has a bottom end part thereof swingably supported on a supporting portion 101*a* of a main body frame 101, and has fixed to a top end part a metal engaging pin 43*a* inserted through the guide hole 41*a* in the first rail member 41. As shown in FIG. 6, the outer diameter d1 of the engaging pin 43*a* is smaller than the inner diameter d2 of the guide hole 41*a*.

The sum length (coupled length) of the first rail member 41 and the second rail member 43 increases and decreases as the engaging pin 43*a* moves within the guide hole 41*a*. Specifically, when the engaging pin 43*a* is located in a bottom end part of the guide hole 41*a*, the first and second rail members 41 and 43 have the maximum coupled length. When the engaging pin 43*a* is located in a top end part of the guide hole 41*a*, the first and second rail members 41 and 43 have the minimum coupled length.

The first coil spring 45 has one end thereof coupled to a top end part of the first rail member 41, and the other end coupled to the engaging pin 43*a*. The second coil spring 47 has one end thereof coupled to a bottom end part of the first rail member 41, and the other end coupled to a lower part of the second rail member 43. The first and second coil springs 45 and 47 exert a damper effect as they stretch and contract.

The slide member 50 is a resin member fixed to an outer circumferential part of the engaging pin 43*a*, and is slidably supported along an inner surface of the first rail member 41. As shown in FIG. 6, the slide member 50 is formed in a shape with a U-shaped section and has side surface portions 50*a* and 50*b* facing each other and a coupling portion 50*c* coupling end parts of the side surface portions 50*a* and 50*b* together. The slide member 50 has the engaging pin 43*a* fixed to it such that the engaging pin 43*a* penetrates the side surface portions 50*a* and 50*b*. Then, an end part of the first coil spring 45 engages with the outer circumferential surface of the engaging pin 43*a* exposed through a part between the side surface portions 50*a* and 50*b*.

Tip ends of the side surface portions 50*a* and 50*b* are in contact with the inner surface of the side face cover 33, and the coupling portion 50*c* is contact with the inner surface of the first rail member 41. That is, by the slide member 50, the engaging pin 43*a* is held at a predetermined interval from a circumferential rim portion of the guide hole 41*a* so as not to be in contact with the guide hole 41*a*.

Now, a description will be given of how the transport unit 35 is swung together with the side face cover 33 to open the sheet transport passage 14. When the side face cover 33 is in a close position, as shown in FIG. 5, the engaging pin 43*a* and the slide member 50 are located in a top end part of the guide hole 41*a*, and the first and second rail members 41 and 43 have the minimum coupled length. Here, the first and second coil springs 45 and 47 have contracted to their natural length.

First, hooking a finger on a bottom end of an opening/closing lever 34 (see FIG. 2) and pulling it up permits hooks 37 (see FIG. 3), which are arranged on opposite ends of the side face cover 33, to swing so as to release the engagement with image forming apparatus 100 main body-side engaging portions (unillustrated). Then, as the side face cover 33 swings in the down direction about the fulcrum 33*a*, together with the side face cover 33, the transport unit 35 also swings in the down direction (the counter-clockwise direction in FIG. 3) about the support shaft 35*a*. The heavier the transport unit 35 is, the greater the moment is resulting from the swinging of the side face cover 33 and the transport unit 35. As a result, the side face cover 33 and the transport unit 35 swing impetuously in the down direction.

As the side face cover 33 swings, the first rail member 41 fixed inside the side face cover 33 and the second rail member 43 swingably supported on the main body frame 101 move away from each other, and the engaging pin 43*a* moves downward together with the slide member 50 along the guide hole 41*a*. As the first and second rail members 41 and 43 extend, the first and second coil springs 45 and 47 stretch. Here, the biasing force of the first and second coil springs 45 and 47 acts in a direction in which the moment resulting from the swinging of the side face cover 33 and the transport unit 35 is reduced.

That is, the biasing force of the first and second coil springs 45 and 47 acts as a damper when the side face cover 33 and the transport unit 35 are opened; this reduces the speed at which the side face cover 33 and the transport unit 35 are opened. Thus, it is possible to enhance the safety of opening operation of the side face cover 33 and the transport unit 35 by a user.

When the side face cover 33 and the transport unit 35 are closed by swinging them in the up direction, the restoring force of the stretched first and second coil springs 45 and 47 acts as a support force for swinging the side face cover 33 and the transport unit 35 in the up direction; this helps reduce the burden of closing operation of the side face cover 33 and the transport unit 35 by a user.

In this embodiment, owing to the slide member 50 being fixed to the engaging pin 43*a* of the second rail member 43 and being in contact with the side face cover 33 and the first rail member 50, when the first and second rail member 41 and 43 are extended or shortened, the engaging pin 43*a* does not make contact with an inner circumferential rim of the guide hole 41*a*. Thus, it is possible to suppress sliding noise and wear resulting from contact between metal members.

As shown in FIG. 4, to the inner surface of the side face cover 33, a sheet member 51 made of sponge is attached in the sliding region of the slide member 50. The friction coefficient between the sheet member 51 and the slide member 50 is higher than the friction coefficient between the side face cover 33 and the slide member 50. Thus, a friction force is generated between the slide member 50 and the sheet member 51, and thereby, in addition to the biasing force of the first and second coil springs 45 and 47, the friction force between the slide member 50 and the sheet member 51 acts as a damper when the side face cover 33 and the transport unit 35 are closed.

It is thus possible to further improve the damper effect, and to slowly stop the side face cover 33 and the transport unit 35 in the open position. The side face cover 33 and the transport unit 35 are prevented from bouncing off from the open state due to the restoring force of the stretched first and second coil springs 45 and 47.

The friction force between the slide member 50 and the sheet member 51 varies according to the pressing force between the slide member 50 and the sheet member 51. With a constant distance between the slide member 50 and the inner surface of the side face cover 33, the pressing force between the slide member 50 and the sheet member 51 varies according to the thickness of the sheet member 51. That is, the sliding load of the first and second rail member 41 and 43 can be varied by adjusting the thickness of the sheet member 51. Thus, by adjusting the thickness of the sheet member 51 such that the moment resulting from the swinging of the side face cover 33 and the transport unit 35 balances with the damper effect of the damper mechanism 40, it is possible to provide a free-stop mechanism that permits the side face cover 33 to stop at any position between the close position and the utmost open position.

Figure 7:
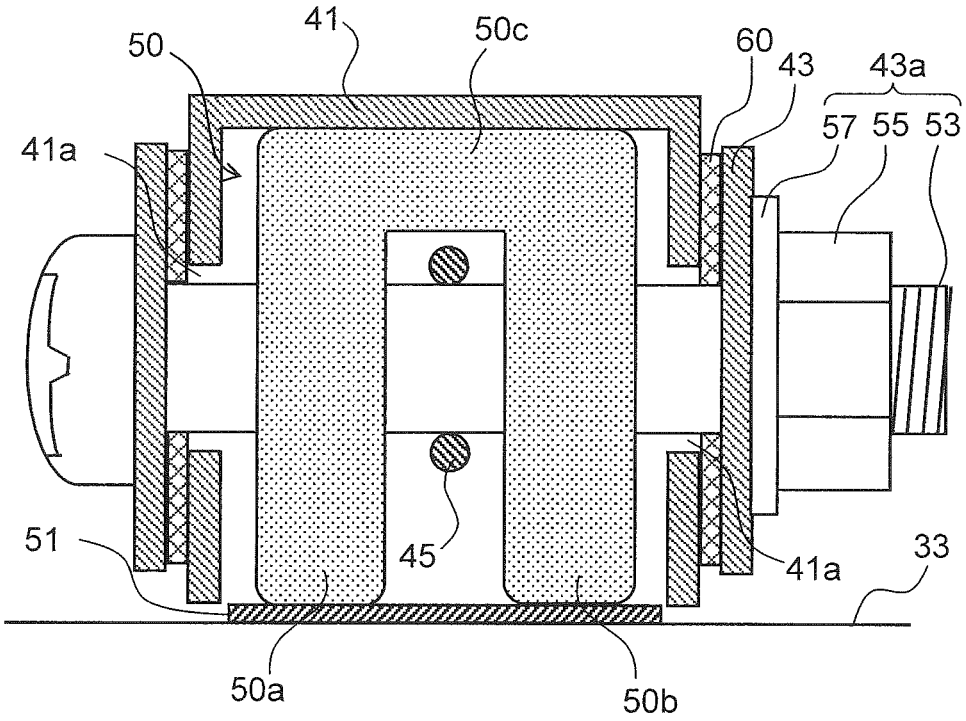
FIG. 7 is a sectional view of a damper mechanism according to a second embodiment of the present disclosure as cut in the direction perpendicular to the longitudinal direction at the position of a slide member.

FIG. 7 is a side view around a slide member 50 of a damper mechanism 40 according to a second embodiment of the present disclosure as seen from a second rail member 43 side. In this embodiment, an engaging pin 43*a* inserted into the slide member 50 is composed of a bolt 53, a nut 55, and a washer 57. Between the outer surface of a first rail member 41 and the inner surface of the second rail member 43, an elastic member 60 is provided. Otherwise, the structure of the damper mechanism 40 is similar to that in the first embodiment.

In this embodiment, engaging the bolt 53 with the nut 55 increases a pressing force with which the second rail member 43 makes contact with the first rail member 41 via the elastic member 60. That is, by adjusting the tightness of engagement between the bolt 53 and the nut 55, the sliding load of the first and second rail members 41 and 43 can be varied. Thus, by adjusting the tightness of engagement between the bolt 53 and the nut 55 such that the moment resulting from the swinging of the side face cover 33 and the transport unit 35 balances with the damper effect of the damper mechanism 40, it is possible to provide a free-stop mechanism that permits the side face cover 33 to stop at any position between the close position and the utmost open position.

Although in this embodiment, the elastic member 60 is provided between the outer surface of the first rail member 41 and the inner surface of the second rail member 43, instead of providing the elastic member 60 therebetween, the washer 57 may be a wave washer.

The embodiments described above are in no way meant to limit the present disclosure, which thus allows for many modifications and variations within the spirit of the present disclosure. For example, although in the above-described embodiments, the sheet member 51 made of sponge is attached to the sliding region of the slide member 50 in the inner surface of the side face cover 33, the material of the sheet member 51 is not limited to sponge as long as it has a friction coefficient higher than that of the side face cover 33 with respect to the slide member 50, and thus it may, for example, be made of rubber. The sheet member 51 may be attached to, instead of or in addition to the inner surface of the side face cover 33, the sliding region of the slide member 50 in the inner surface of the first rail member 41.

Although in the above-described embodiments, the damper mechanism 40 is provided for reducing the shock occurring when the side face cover 33 and the transport unit 35 are opened or closed, this is in no way mean to limit the damper mechanism 40 according to the present disclosure; and it is applicable also to other opening/closing members that are opened or closed.

The present disclosure is applicable to a damper mechanism of an opening/closing member used in image forming apparatuses such as copiers, printers, facsimile machines, and multifunctional peripherals thereof. Based on the present disclosure, it is possible to provide a damper mechanism that can improve the operability by reducing the weight, shock, contact noise, and the like felt or generated when an opening/closing member is opened or closed with a simple configuration, and to provide an image forming apparatus incorporating such a damper mechanism.

What is claimed is:

1. A damper mechanism provided between a main body of an image forming apparatus and an opening/closing member supported on the main body of the image forming apparatus so as to be swingable up and down between an open position and a close position with a bottom end part of the opening/closing member serving as a fulcrum, the damper mechanism reducing a moment generated when the opening/closing member is swung from the close position to the open position, the damper mechanism comprising:

a first rail member fixed inside the opening/closing member along an up/down direction, the first rail member having a guide hole formed therein in a shape of an oblong hole extending along a longitudinal direction;

a second rail member having fixed to a top end part thereof an engaging pin inserted through the guide hole, the second rail member having a bottom end part swingably supported on the main body of the image forming apparatus;

a biasing member which biases the second rail member and the first rail member in a direction in which the second rail member and the first rail member approach each other; and a slide member made of resin, the slide member being fixed to the engaging pin, the slide member sliding while in contact with the first rail member and the opening/closing member with a predetermined interval between the engaging pin and an inner circumferential rim of the guide hole, wherein the biasing member includes a first coil spring having one end thereof coupled to a top end part of the first rail member and another end coupled to the engaging pin, and a second coil spring having one end thereof coupled to a bottom end part of the first rail member and another end coupled to the second rail member below the engaging pin.

2. The damper mechanism of claim 1, wherein on at least one of an inner surface of the opening/closing member and the first rail member, in a sliding region of the slide member, a sheet member is arranged which has a friction coefficient higher than a friction coefficient of the opening/closing member and the first rail member with respect to the slide member.

3. The damper mechanism of claim 2, wherein by arranging the sheet member of a different thickness in the sliding region of the slide member, a sliding load of the first and second rail members is varied.

4. The damper mechanism of claim 3, wherein by arranging the sheet member of a different thickness in the sliding region of the slide member such that the moment resulting from swinging of the opening/closing member balances with the sliding load of the first and second rail members, the opening/closing member is stopped at any position between the close position and the utmost open position.

5. The damper mechanism of claim 1, wherein the engaging pin includes a bolt penetrating the guide hole and a nut engaged with the bolt, and by adjusting tightness of engagement between the bolt and the nut, a sliding load of the first and second rail members is varied.

6. The damper mechanism of claim 5, wherein an elastic member is provided on a sliding surface between the first and second rail members.

7. The damper mechanism of claim 6, wherein by adjusting the tightness of engagement between the bolt and the nut such that the moment resulting from swinging of the opening/closing member balances with the sliding load of the first and second rail members, the opening/closing member is stopped at any position between the close position and the utmost open position.

8. An image forming apparatus comprising the damper mechanism of claim 1.

9. The image forming apparatus of claim 8, wherein the opening/closing member includes a cover member provided so as to be openable/closable with respect to the main body of the image forming apparatus, and a transport unit swingably supported inside the cover member.

10. A damper mechanism provided between a main body of an image forming apparatus and an opening/closing member supported on the main body of the image forming apparatus so as to be swingable up and down between an open position and a close position with a bottom end part of the opening/closing member serving as a fulcrum, the damper mechanism reducing a moment generated when the opening/closing member is swung from the close position to the open position, the damper mechanism comprising:

a first rail member fixed inside the opening/closing member along an up/down direction, the first rail member having a guide hole formed therein in a shape of an oblong hole extending along a longitudinal direction;

a second rail member having fixed to a top end part thereof an engaging pin inserted through the guide hole, the second rail member having a bottom end part swingably supported on the main body of the image forming apparatus;

a biasing member which biases the second rail member and the first rail member in a direction in which the second rail member and the first rail member approach each other; and a slide member made of resin, the slide member being fixed to the engaging pin, the slide member sliding while in contact with the first rail member and the opening/closing member with a predetermined interval between the engaging pin and an inner circumferential rim of the guide hole, wherein the engaging pin includes a bolt penetrating the guide hole and a nut engaged with the bolt, and by adjusting tightness of engagement between the bolt and the nut, a sliding load of the first and second rail members is varied, an elastic member is provided on a sliding surface between the first and second rail members, and by adjusting the tightness of engagement between the bolt and the nut such that the moment resulting from swinging of the opening/closing member balances with the sliding load of the first and second rail members, the opening/closing member is stopped at any position between the close position and the utmost open position.

11. An image forming apparatus comprising the damper mechanism of claim 10.

12. The image forming apparatus of claim 11, wherein the opening/closing member includes a cover member provided so as to be openable/closable with respect to the main body of the image forming apparatus, and a transport unit swingably supported inside the cover member.

* * * * *